US010682689B2

(12) United States Patent
Higa

(10) Patent No.: US 10,682,689 B2
(45) Date of Patent: Jun. 16, 2020

(54) CONTINUOUS CASTING NOZZLE DEFLECTOR

(71) Applicant: AK Steel Properties, Inc., West Chester, OH (US)

(72) Inventor: Ken Morales Higa, West Chester, OH (US)

(73) Assignee: AK Steel Properties, Inc., West Chester, OH (US)

( * ) Notice: Subject to any disclaimer, the term of this patent is extended or adjusted under 35 U.S.C. 154(b) by 261 days.

(21) Appl. No.: 15/819,564

(22) Filed: Nov. 21, 2017

(65) Prior Publication Data

US 2018/0154430 A1 Jun. 7, 2018

Related U.S. Application Data

(60) Provisional application No. 62/425,800, filed on Nov. 23, 2016.

(51) Int. Cl.

| | |
|---|---|
| ***B22D 41/00*** | (2006.01) |
| ***B22D 11/103*** | (2006.01) |
| ***B22D 11/00*** | (2006.01) |
| ***B22D 41/50*** | (2006.01) |

(52) U.S. Cl.
CPC ..... *B22D 11/103* (2013.01); *B22D 11/001* (2013.01); *B22D 41/50* (2013.01)

(58) Field of Classification Search
CPC ..... B22D 41/50
USPC ..... 222/606, 607
See application file for complete search history.

(56) References Cited

U.S. PATENT DOCUMENTS

| | | | | |
|---|---|---|---|---|
| 6,675,996 | B1 | 1/2004 | Miyamoto et al. | |
| 2011/0240688 | A1* | 10/2011 | Mizobe | B22D 41/50 222/591 |
| 2018/0154430 | A1* | 6/2018 | Higa | B22D 41/50 |
| 2019/0232364 | A1* | 8/2019 | Higa | B22D 11/10 |

FOREIGN PATENT DOCUMENTS

| | | |
|---|---|---|
| GB | 2444805 A | 6/2008 |
| TW | 544353 B | 8/2003 |
| WO | WO 01/17715 A1 | 3/2001 |

OTHER PUBLICATIONS

International Search and Written Opinion for International PCT Application No. PCT/US2017/062842, 12 pages.
Taiwanese Office Action dated Jun. 29, 2018 for Application No. 106140734, 18 pgs.

* cited by examiner

*Primary Examiner* — Scott R Kastler
(74) *Attorney, Agent, or Firm* — Frost Brown Todd LLC

(57) ABSTRACT

A continuous casting nozzle includes a deflector at a bottom portion of the nozzle having a bore extending through the deflector from an open end to a closed end along a longitudinal axis and a pair of ports extending through the deflector from the bore to an outer surface of the deflector. A diameter of the bore substantially rapidly decreases along the longitudinal axis above the pair of ports such that a portion of a flow of fluid through the deflector becomes detached from a surface of the bore to thereby redirect the flow of fluid toward the longitudinal axis prior to exiting through the pair of ports.

18 Claims, 11 Drawing Sheets

CONTINUOUS CASTING NOZZLE DEFLECTOR

PRIORITY

This application claims priority to U.S. Provisional Application Ser. No. 62/425,800, entitled "Continuous Casting Nozzle Tapered Deflector Bore Design for Improved Fluid Flow," filed on Nov. 23, 2016, the disclosure of which is incorporated by reference herein.

BACKGROUND

Continuous casting can be used in steelmaking to produce semi-finished steel shapes such as ingots, slabs, blooms, billets, etc. During a typical continuous casting process (10), as shown in FIG. 1, liquid steel (2) may be transferred to a ladle (12), where it may flow from the ladle (12) to a holding bath, or tundish (14). The liquid steel (2) may then flow into a mold (18) via a nozzle (20). In some versions, a sliding gate assembly (16) is selectively opened and closed to selectively start and stop the flow of the liquid steel (2) into the mold (18).

A typical continuous casting nozzle (20), or submerged entry nozzle (SEN), is shown in more detail in FIGS. 2 and 3. For instance, the nozzle (20) may comprise a bore (26) extending through the nozzle (20) along a central longitudinal axis (A) to a closed end (28) at a bottom portion (B) of the nozzle (20). As best seen in FIG. 2, the bore (26), at the bottom portion (B), is defined by substantially straight walls of the nozzle (20) that are substantially parallel with the longitudinal axis (A) to form a substantially cylindrical profile. A pair of ports (24) may then be positioned through opposing side surfaces of the nozzle (20) proximally above the closed end (28) of the nozzle (20). Accordingly, the liquid steel (2) may flow through the bore (26) of the nozzle (20), out of the ports (24), and into the mold (18).

As the sliding gate assembly (16) moves to an open position from a closed position to allow the liquid steel (2) to flow into the mold (18), the incoming turbulent steel jet (3) may flow near the wall of the bore (26) of the nozzle (20), as shown in FIG. 4. Such a turbulent steel jet (3) flowing on one side of the bore (26) may produce a swirl as the steel jet (3) reaches the bottom portion (B) of the bore (26) and may be constricted with a well shape at the closed end (28) of the nozzle (20). This swirl may divide the mainstream steel jet (3) into two flow paths (4) in opposite directions when liquid steel (2) is discharged into the mold (18) from the two ports (24). A lubricant, such as a mold powder or mold flux, is generally added to the metal in the mold (18) to prevent the liquid steel (2) from adhering to the surfaces of the mold (18).

In some instances in the prior art, the flow paths (4) of the liquid steel (2) from the ports (24) of the nozzle (20) become uneven and biased such that the liquid steel (2) is directed in a downward direction toward a broad face (19) of the mold (18), as shown in FIGS. 4-8. For instance, in the illustrated embodiment, the ports (24) are aligned to extend outward from the longitudinal axis along a plane (C). As the liquid steel (2) exits the ports (24), the flow path (4) of the liquid steel (2) is offset from the plane (C). Such uneven flow paths (4) of the liquid steel (2) from the nozzle (20) to the mold (18) can form surface defects, such as longitudinal cracks, in the mold (18). This may be due to uneven distribution of mold flux and non-uniform cooling at the meniscus. A poor lubrication may result in temperature gradients provided by direct contact of liquid steel (2) to the surface of the mold (18). These temperature gradients may induce additional thermal stresses to the solidifying steel shell. In peritectic steel grades, this may further produce an increased shrinkage of the steel shell provided by the peritectic phase transformation.

Moreover, such uneven flow paths (4) throughout the mold (18) may produce liquid mold powder entrainment and/or uneven heat transfer. These uneven flow paths (4) may be enhanced when the nozzle (20) starts to clog with clusters of foreign particles in the steel (2). The agglomeration and attachment of these particles at different zones of the body of the nozzle (20) may distort the initial internal geometry, and may thereby change the flow paths (4) in the mold (18). Accordingly, once the nozzle (20) is clogged to a predetermined amount, the nozzle (20) may need to be changed. An increase of nozzle (20) changes during a sequence due to clogging may reduce the quality of the steel (2) as the flow paths (4) in the mold (18) are changed during the time the new nozzle (20) reaches steady state again. Such uneven flow paths (4) may require the mold operator to manually feed mold powder given that the melting rate becomes different and unsteady from one side of the mold (18) to the other.

Accordingly, there is a need to provide a continuous casting nozzle that produces a more uniform flow path of liquid steel into a mold.

SUMMARY

A deflector is provided at a bottom portion of a continuous casting nozzle to improve fluid flow of the liquid steel into a mold by redirecting the liquid steel toward a central portion of the bore of the nozzle. This may reduce the number of laminations by mold powder entrainment, nozzle clogging, nozzle changes, surface defects in the mold, scarfing practices on slabs, interruptions in the operation, and/or manually feeding mold powder. Accordingly, such a continuous casting nozzle may improve the quality of the molded steel and the efficiency of the continuous casting process, while reducing costs.

DESCRIPTION OF FIGURES

It is believed that the present invention will be better understood from the following description of certain examples taken in conjunction with the accompanying drawings, in which like reference numerals identify like elements.

Figure 1:
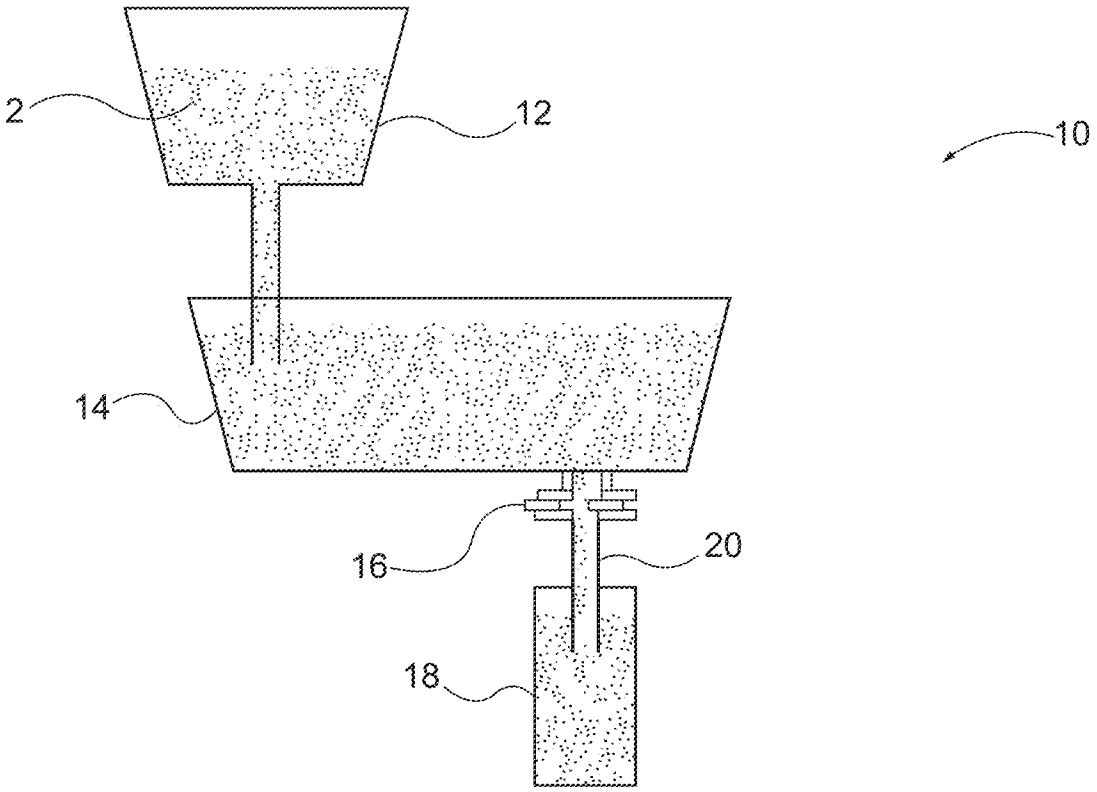
FIG. 1 depicts schematic of a continuous casting process.
Figure 2:
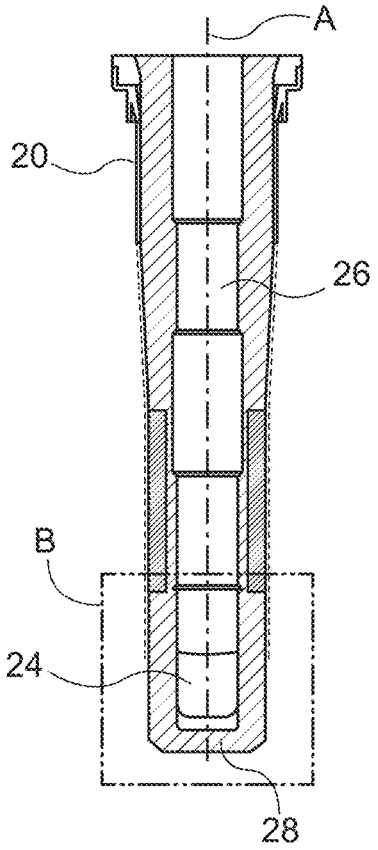
FIG. 2 (PRIOR ART)
FIG. 2 depicts a cross-sectional side view of a prior art continuous casting nozzle of the continuous casting process of FIG. 1.
Figure 3:
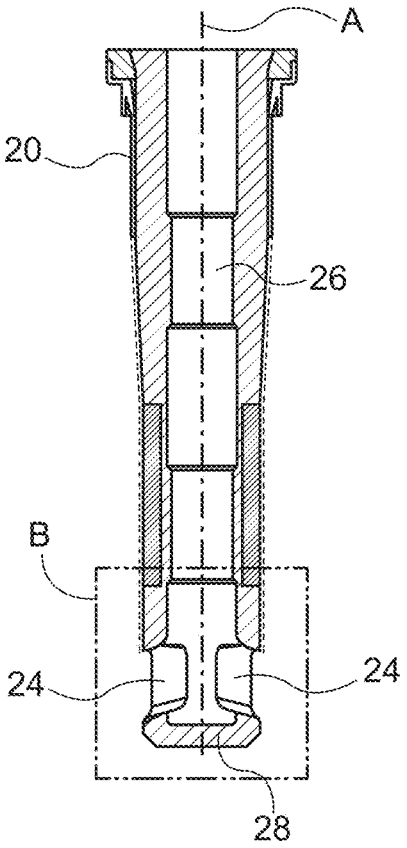
FIG. 3 (PRIOR ART)
FIG. 3 depicts a cross-sectional front view of the prior art nozzle of FIG. 2.
Figure 5:
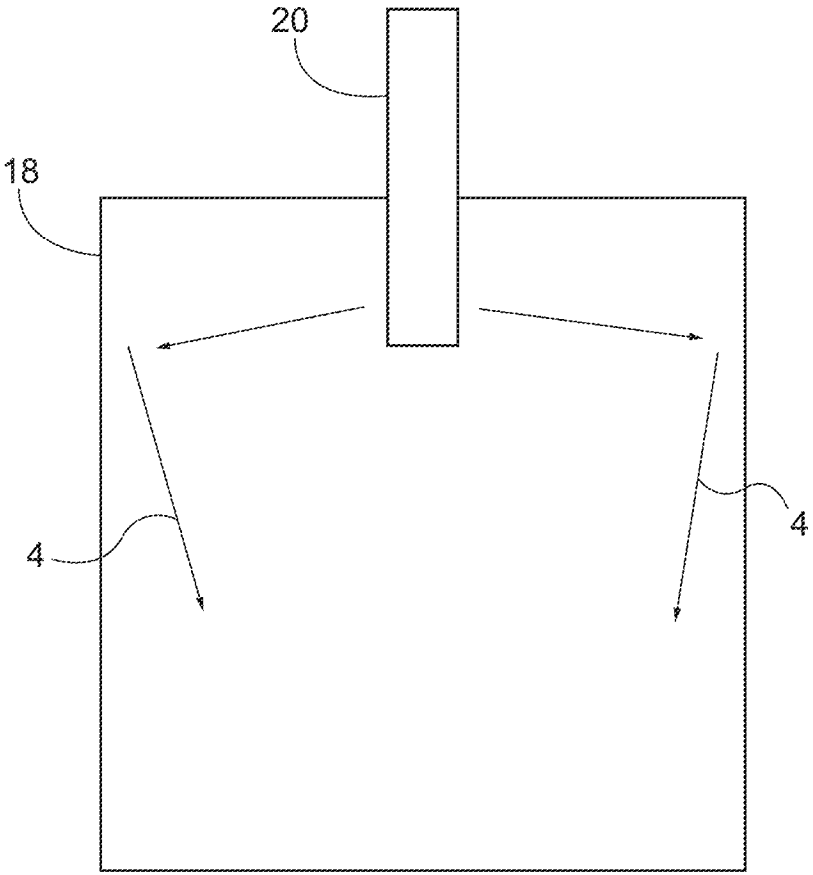
FIG. 5 (PRIOR ART)
FIG. 5 depicts a front view of the prior art flow path of FIG. 4.
Figure 4:
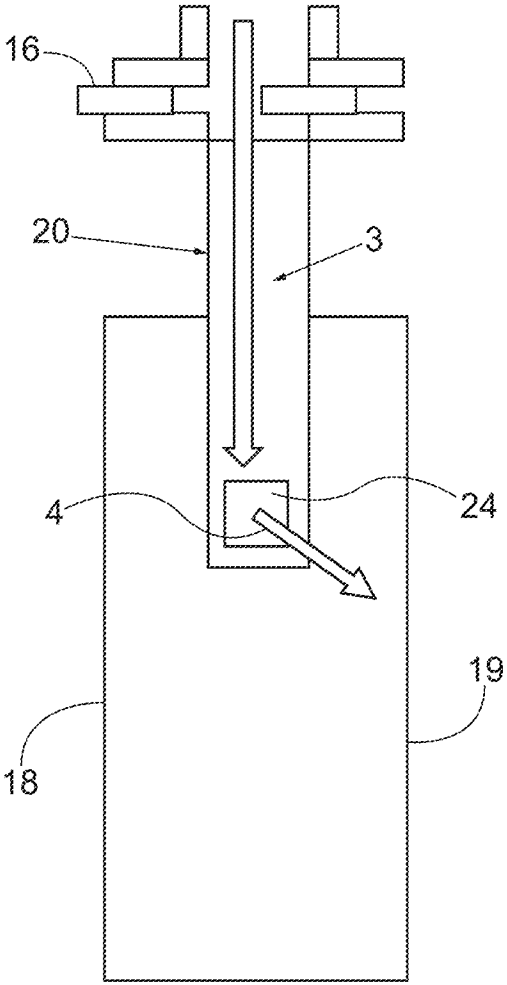
FIG. 4 (PRIOR ART)
FIG. 4 depicts a side elevational view of steel flowing through the prior art nozzle of FIG. 2 and into a mold to form a flow path.
Figure 7:
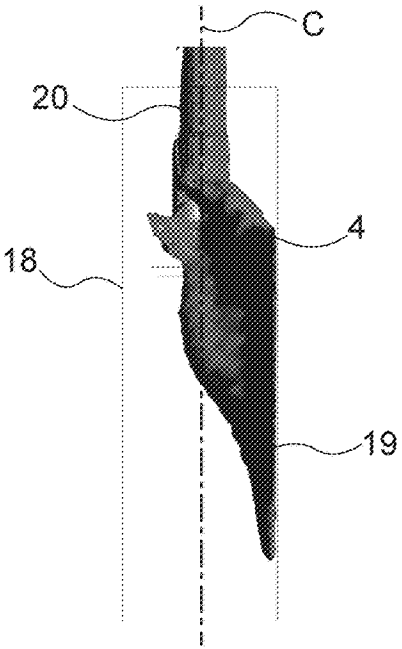
FIG. 7 (PRIOR ART)
FIG. 7 depicts a side elevational view of the prior art flow path of FIG. 4.
Figure 6:
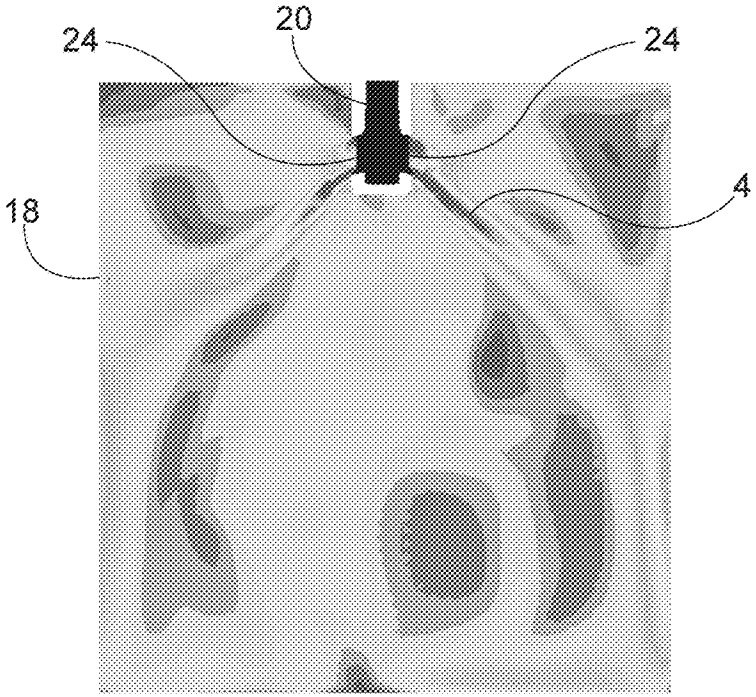
FIG. 6 (PRIOR ART)
FIG. 6 depicts a front view of the prior art flow path of FIG. 4.
Figure 8:
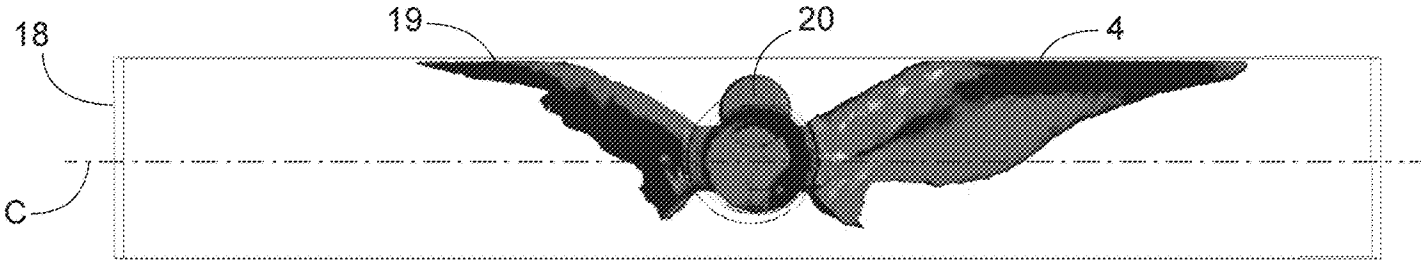
FIG. 8 (PRIOR ART)
FIG. 8 depicts a bottom plan view of the prior art flow path of FIG. 4.

The drawings are not intended to be limiting in any way, and it is contemplated that various embodiments of the present disclosure may be carried out in a variety of other ways, including those not necessarily depicted in the drawings. The accompanying drawings incorporated in and forming a part of the specification illustrate several aspects of the present disclosure, and together with the descriptions serve to explain the principles and concepts of the present disclosure; it being understood, however, that the present disclosure is not limited to the precise arrangements shown.

DETAILED DESCRIPTION

The following description and embodiments of the present disclosure should not be used to limit the scope of the present disclosure. Other examples, features, aspects, embodiments, and advantages of the present disclosure will become apparent to those skilled in the art from the following description. As will be realized, the present disclosure may contemplate alternate embodiments than those exemplary embodiments specifically discussed herein without departing from the scope of the present disclosure. Accordingly, the drawings and descriptions should be regarded as illustrative in nature and not restrictive.

Figure 10:
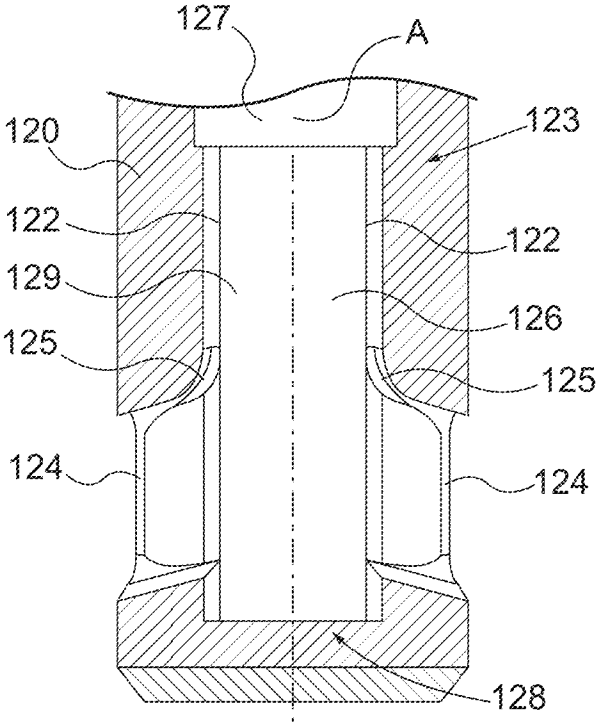
FIG. 10 depicts a cross-sectional view of the nozzle of FIG. 9 taken along line 10-10 of FIG. 9.
Figure 9:
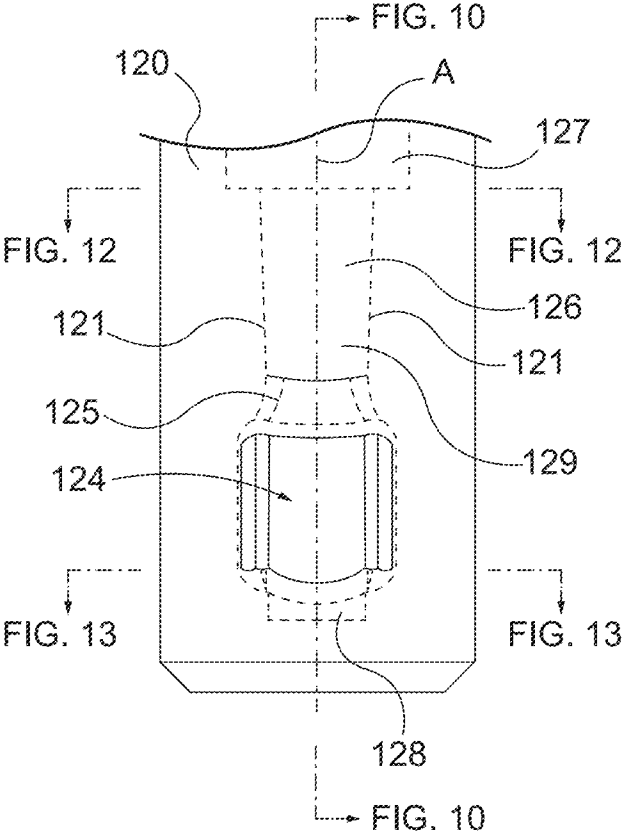
FIG. 9 depicts a side elevational view of a bottom portion of another continuous casting nozzle for use with the continuous casting process of FIG. 1.

Referring to FIGS. 9-13, an embodiment of an improved deflector (120) is shown that can be incorporated in a bottom portion (B) of a bifurcated continuous casting nozzle (20) of the continuous casting process (10) described above. Such a deflector (120) is configured to improve fluid flow of liquid steel (2) in a continuous casting mold (18) by redirecting the liquid steel (2) to a central portion of a bore (126) of the nozzle (20). Referring to FIG. 9, the deflector (120) comprises a bore (126) extending through the deflector (120) along a longitudinal axis (A), having an upper portion (127) and a lower portion (129). In the illustrated embodiment, the upper portion (127) of the bore (126) has a larger diameter than the lower portion (129) of the bore (126) such that a shelf (123) is formed between the upper and lower portions (127, 129) that steps inward within the bore (126). Such a shelf (123) comprises a substantially rapid decrease in the diameter of the bore (126) that is sufficient to detach a portion of a flow of the fluid through the bore (126) from one or more of the walls (121, 122) of the bore at the substantially rapid decreased diameter to centrally redirect the flow of the fluid toward the longitudinal axis (A) of the deflector (120). Still other suitable configurations for the shelf (123) will be apparent to one with ordinary skill in the art in view of the teachings herein. The bore (126) of the illustrated embodiment further comprises a closed end (128) at a bottom of the bore (126). A pair of ports (124) are positioned proximally above the closed end (128) on opposing sides walls (122) of the bore (126) of the deflector (120), as shown in FIG. 10. Each port (124) of the pair of ports (124) extends from the bore (126) to an outer surface of the deflector (120).

Figure 13:
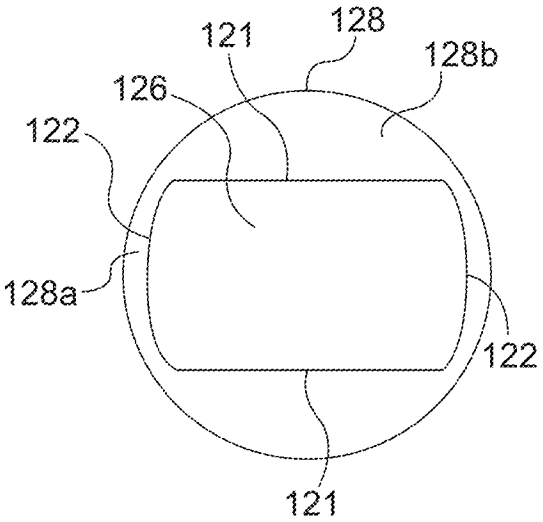
FIG. 13 depicts a cross-sectional view of the nozzle of FIG. 9 taken along line 13-13 of FIG. 9.
Figure 12:
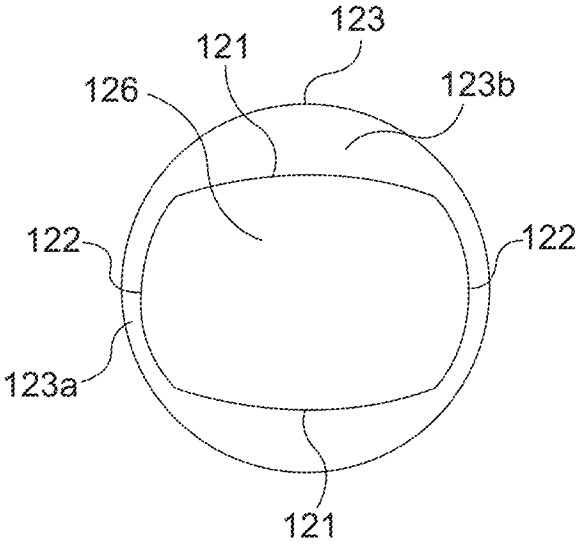
FIG. 12 depicts a cross-sectional view of the nozzle of FIG. 9 taken along line 12-12 of FIG. 9.

In the illustrated embodiment, the bore (126) comprises a first pair of walls (121) and a second pair of side walls (122) such that each wall (121) of the first pair of walls (121) is transverse to each wall (122) in the second pair of side walls (122). The walls (121) of the first pair of walls (121) taper inward toward the longitudinal axis (A) in the lower portion (129) of the bore (126) from the shelf (123) to the closed end (128), as best seen in FIG. 9. Accordingly, the walls (121) taper from an arcuate shape shown in FIG. 12 to a substantially flat shape shown in FIG. 13 such that the thickness of the deflector (120) at the walls (121) increases from the surface (123*b*) at the shelf (123) to the surface (128*b*) at the closed end (128). The shelf (123) at the walls (121) further has a larger step inward than at the side walls (122). Referring to FIG. 10, the side walls (122) form an arcuate shape and are substantially parallel with the longitudinal axis (A) from the shelf (123) to the closed end (128) such that the side walls (122) are not tapered to form a uniform thickness of the deflector (120) from the surface (123*a*) at the shelf (123) to the surface (128*a*) at the closed end (128), as shown in FIGS. 12 and 13. The bore (126) thereby changes from a generally circular shape at the upper portion (127), to a generally elliptical shape at the top of the lower portion (129), and to a generally rectangular shape at the bottom of the lower portion (129), but any other suitable shapes can be used.

Figure 11:
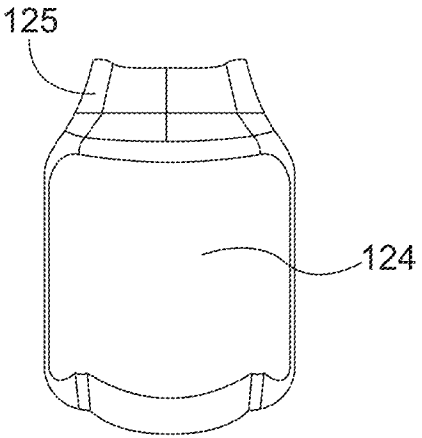
FIG. 11 depicts a partial side elevational view of the nozzle of FIG. 9, showing a port of the nozzle.

These side walls (122) comprise the opposing ports (124) on each side wall (122). Each port (124) may be aligned to extend outwardly from the longitudinal axis (A) along a plane (C). Referring to FIG. 11, each port (124) comprises a substantially square opening, but any other suitable shape can be used. Each port (124) may have a width of about 65 mm and a length of about 65 mm, but any other suitable dimensions can be used. As best seen in FIG. 10, at least one fillet (125) is positioned above each port (124) of the side walls (122) to form a rounded surface between the side walls (122) and the ports (124). The walls of the ports (124) may then be angled downward through the thickness of the deflector (120). This may be an angle of about 15 degrees relative to the closed end (128), but any other suitable angle can be used. Still other suitable configurations for the deflector (120) will be apparent to one with ordinary skill in the art in view of the teachings herein.

Figure 14:
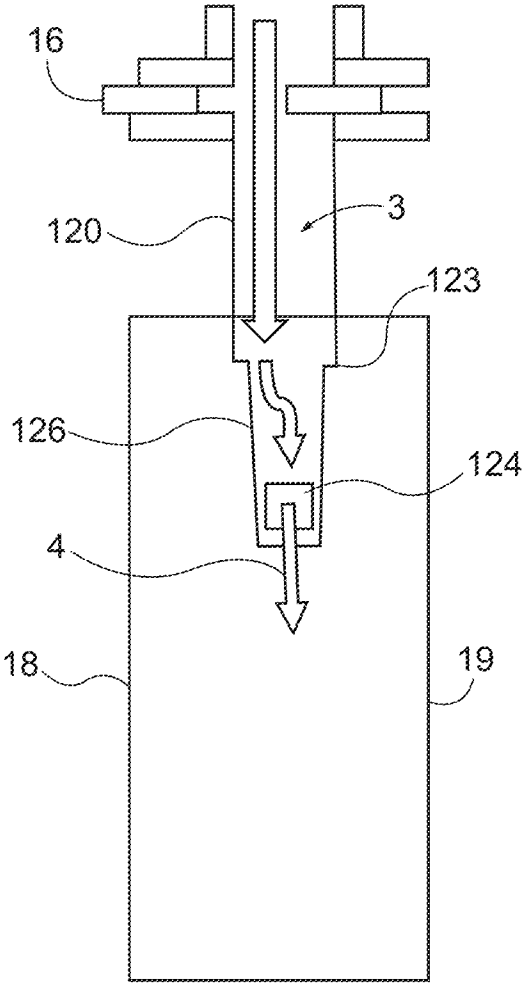
FIG. 14 depicts a side elevational view of steel flowing through the nozzle of FIG. 9 and into a mold to form a flow path.
Figure 17:
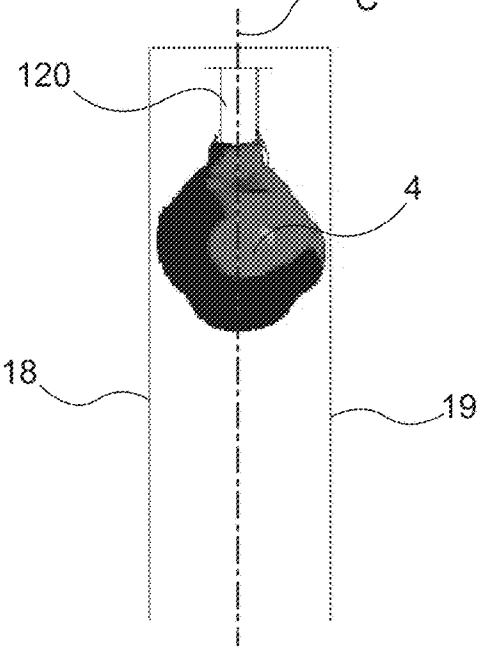
FIG. 17 depicts a side elevational view of the flow path of FIG. 14.
Figure 16:
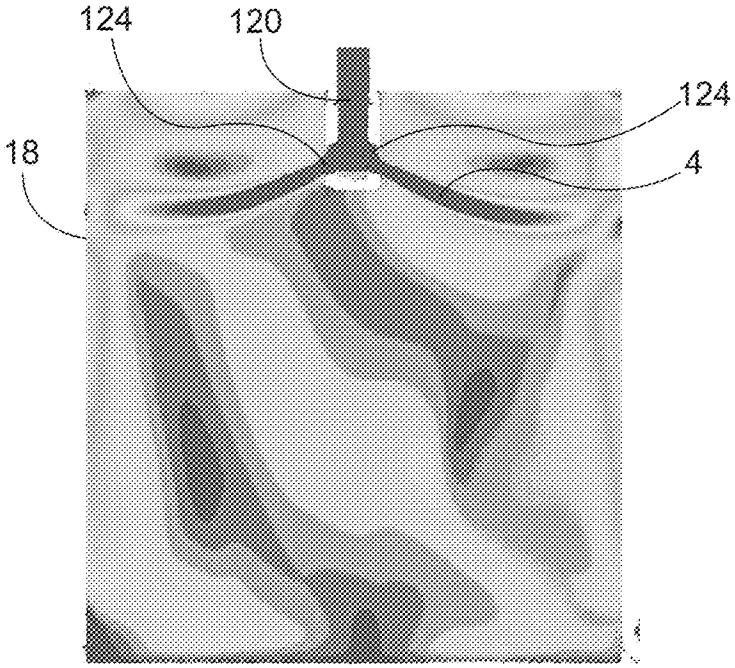
FIG. 16 depicts a front view of the flow path of FIG. 14.
Figure 18:
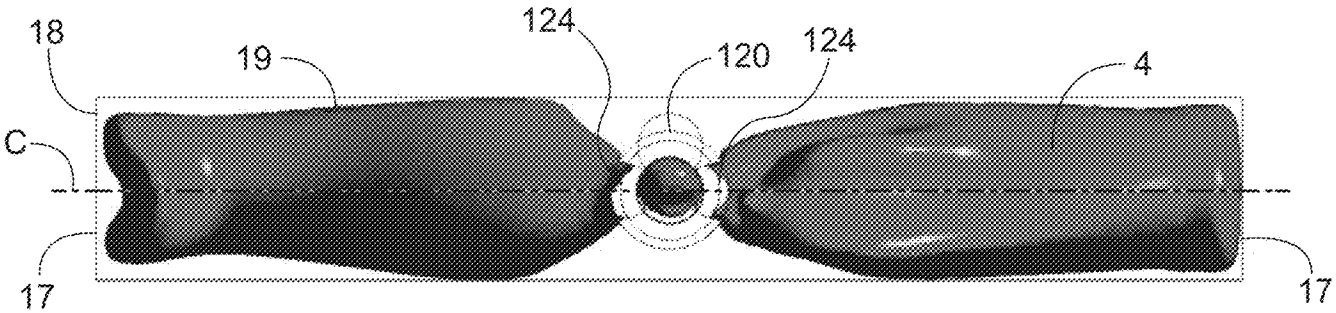
FIG. 18 depicts a bottom plan view of the flow path of FIG. 14.

Accordingly, the deflector (120) may be positioned at a bottom portion of a continuous casting nozzle (20) and positioned within a mold (18) below the bath level of the liquid steel (2). Liquid steel (2) may thereby flow through the deflector (120), out of the ports (124), and into the mold (18). Referring to FIG. 14, as the sliding gate assembly (16) moves to an open position from a closed position to allow the liquid steel (2) to flow into the mold (18), the incoming turbulent steel jet (3) may flow near the wall of the bore (26) of the nozzle (20). The deflector (120) may then redirect at least a portion of the steel jet (3) toward a center of the bore (126) along the longitudinal axis (A) before the steel jet (3) exits the deflector (120) through the ports (124). For instance, the shelf (123) within the deflector (120) may provide a disruption in the flow of the steel jet (3) to detach at least a portion of the steel jet (3) from the wall of the bore (126) to centrally redirect the steel jet (3). The higher step in the shelf (123) on the walls (121) may redirect the steel jet (3) more centrally along the walls (121) than the smaller step in the shelf (123) on the side walls (122) above the ports (124). This smaller discontinuity in the bore (126) used on the side walls (122) parallel to the ports (124) may prevent an abrupt separation of the liquid steel (2) from these side walls (122) of the bore (126) above the ports (124). As the steel jet (3) reaches the closed end (128) of the bore (126), a swirl may be produced in the steel jet (3) that divides into two flow paths (4) in opposite directions when liquid steel (2) is discharged into the mold (18) from the two ports (124).

The fillets (125) positioned above the ports (124) may provide a smooth transition of the liquid steel (2) from the vertical steel jet (3) flowing from the bore (126) to flow paths (4) of the liquid steel (2) exiting the ports (124). Such a smooth transition may reduce nozzle clogging. Further, the taper along the walls (121) in the deflector (120) to the bottom of the bore (126) may increase the momentum in the direction of the centerline of the well bottom to direct the steel jet (3). Accordingly, the larger shelf (123) and/or tapered walls (121) may detach and redirect the steel jet (3) centrally along the walls (121) transverse to the ports (124), while the smaller shelf (123) and/or substantially straight side walls (122) may detach and centrally redirect the steel jet (3) a smaller amount above the ports (124). This may allow the fillets (125) to transition the steel jet (3) out of the ports (124) along the plane (C) aligned with the ports (124) such that the flow paths (4) of the liquid steel (2) impinge the narrow faces (17) of the mold (18) instead of the broad faces (19). This redirection of the discharged liquid steel (2) may thereby prevent high asymmetrical flows throughout the volume of the mold (18) such that the flow paths (4) of the liquid steel (2) exiting the deflector (120) are more symmetrical, as shown in FIGS. 15-18. The more symmetrical flow paths (4) may maintain a more uniform temperature distribution at the meniscus to promote uniform lubrication within the mold (18).

Figure 15:
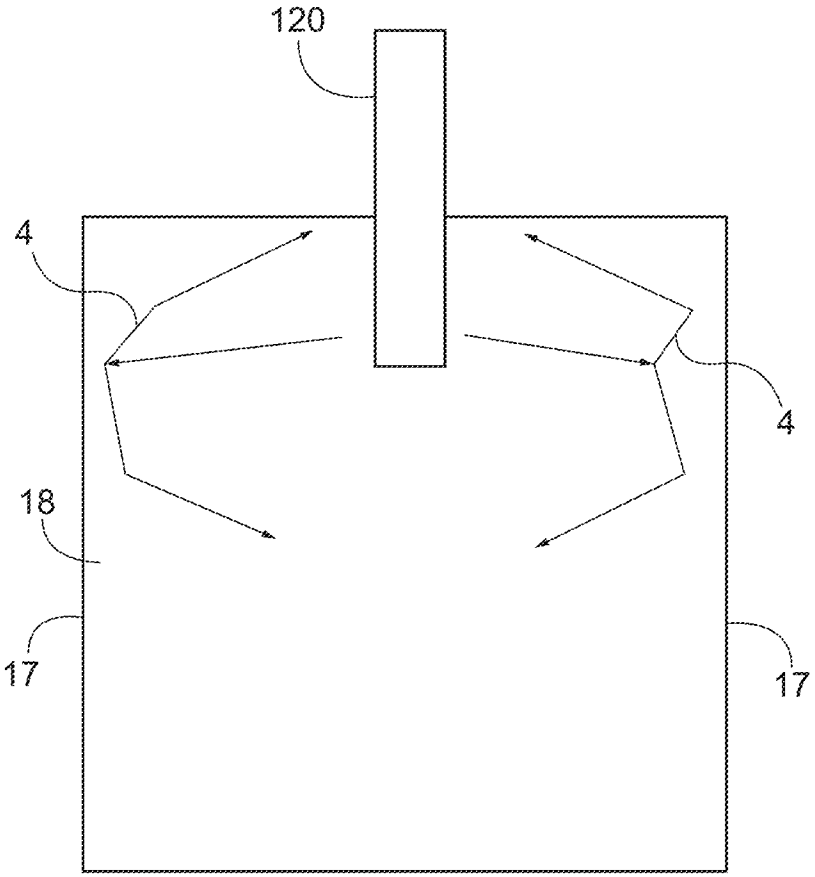
FIG. 15 depicts a front view of the flow path of FIG. 14.

As best seen in FIG. 15, a mainstream of the flow path (4) may flow downward along the plane (C) toward a narrow face of the mold (18) and a secondary stream of the flow path (4) may flow upwards along plane (C), in an opposite direction to the mainstream. The shape of the deflector (120) may increase the momentum of the upper loops of the secondary stream of the flow paths (4) to create a more desired flow pattern. Accordingly, the more desirable flow paths (4) of the liquid steel (2) formed by the deflector (120) may reduce the number of laminations by mold powder entrainment, reduce nozzle clogging that produces biased flows in the mold (18), reduce the number of nozzle (20) changes that produce biased and unsteady flows, reduce surface defects in the mold (18), reduce scarfing practices on slabs, reduce interruptions in the continuous casting process (10), and/or reduce the manually feeding mold powder in the mold (18). The deflector (120) may thereby improve the quality of the molded steel and the efficiency of the continuous casting process, while reducing costs. Still other suitable configurations and/or flow paths (4) for the deflector (120) will be apparent to one with ordinary skill in the art in view of the teachings herein.

Figure 19:
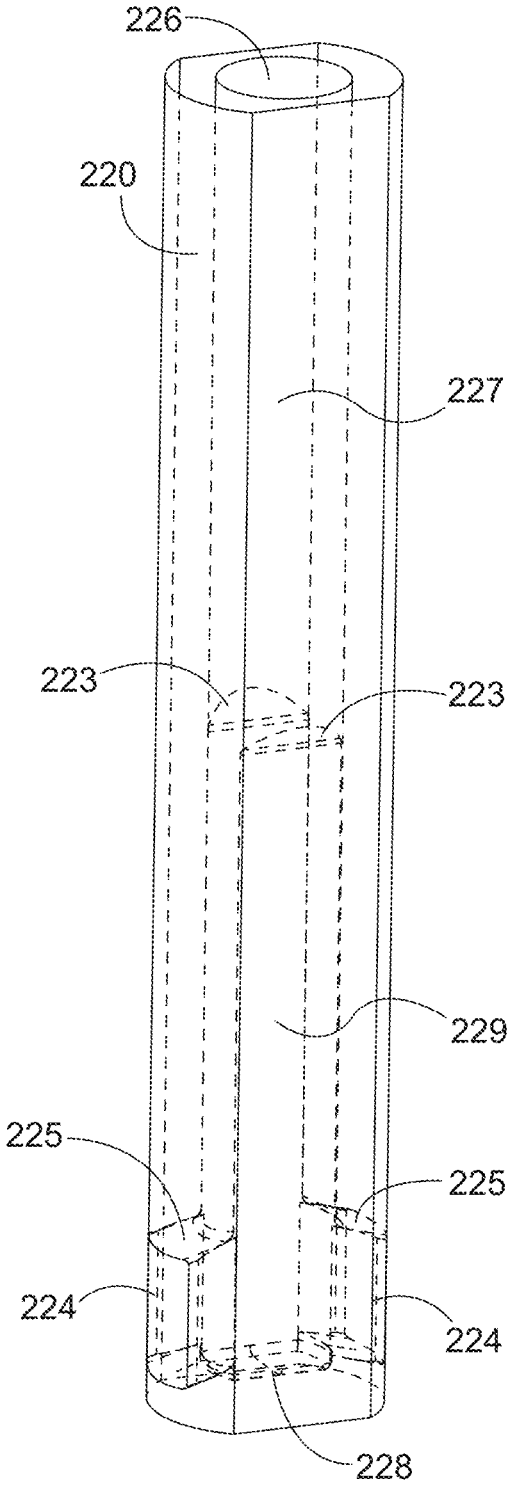
FIG. 19 depicts a perspective view of another continuous casting nozzle for use with the continuous casting process of FIG. 1.
Figure 20:
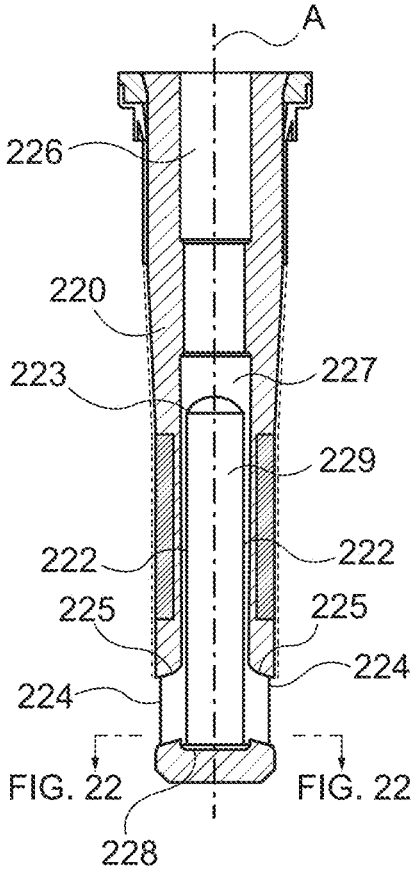
FIG. 20 depicts a front cross-sectional view of the nozzle of FIG. 19.
Figure 21:
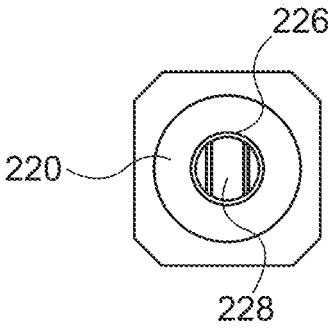
FIG. 21 depicts a top plan view of the nozzle of FIG. 19.
Figure 22:
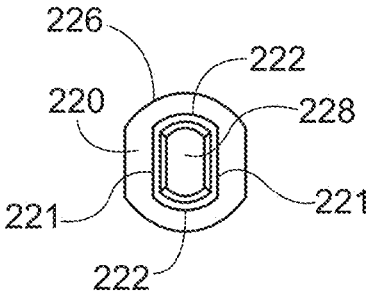
FIG. 22 depicts a cross-sectional view of the nozzle of FIG. 19 taken along line 22-22 of FIG. 20.
Figure 23:
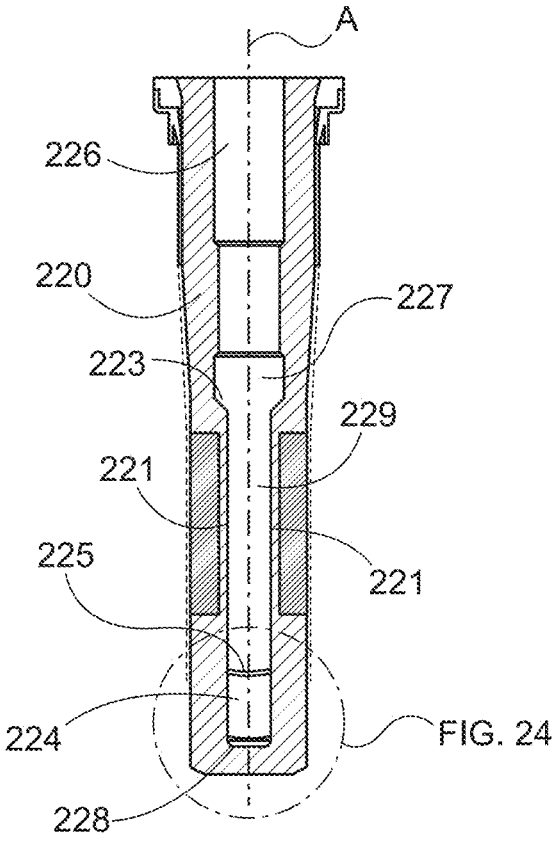
FIG. 23 depicts a cross-sectional side view of the nozzle of FIG. 19.

For instance, another embodiment of a deflector (220) is shown in FIGS. 19-24. The deflector (220) is similar to the deflector (120) described above, except that the deflector (220) comprises a sloped wall (223) instead of a shelf (123). Referring to FIG. 19, the deflector (220) comprises a bore (226) extending through a central portion of the deflector (220) along a longitudinal axis (A), having an upper portion (227) and a lower portion (229). In the illustrated embodiment, the upper portion (227) of the bore (226) has a larger diameter than the lower portion (229) of the bore (226) along the walls (221). As best seen in FIGS. 19 and 23, a sloped wall (223) is positioned between the upper and lower portions (227, 229) that slopes inward within the bore (226) along walls (221) of the bore (226). Such a sloped wall (223) comprises a substantially rapid decrease in the diameter of the bore (226) that is sufficient to detach a portion of a flow of the fluid through the bore (226) from one or more of the walls (221, 222) of the bore (226) at the substantially rapid decreased diameter to centrally redirect the flow of the fluid toward the longitudinal axis (A) of the deflector (220). The bore (226) further comprises a closed end (228) at a bottom of the bore (226). A pair of ports (224) are positioned proximally above the closed end (228) on opposing sides walls (222) of the bore (226) of the deflector (220), as shown in FIGS. 19 and 20. Each port (224) of the pair of ports (224) extends from the bore (226) to an outer surface of the deflector (220) along a plane (C).

The walls (221) of the bore (226) transverse to the side walls (222) are substantially parallel along the longitudinal axis (A), instead of being tapered as in the deflector (120) described above, in the lower portion (229) of the bore (226) from the sloped wall (223) to the closed end (228), as best seen in FIG. 23. Accordingly, the walls (221) have a substantially uniform flat surface, as shown in FIGS. 21 and 22, such that the thickness of the deflector (220) at the walls (221) is substantially constant from the sloped wall (223) to the closed end (228). Referring to FIGS. 20-22, the side walls (222) form an arcuate shape and are also substantially parallel with the longitudinal axis (A) to form a uniform thickness of the deflector (220). The side walls (222) do not have a sloped wall and are substantially straight such that the upper portion (227) and the lower portion (229) of the bore (226) have substantially the same diameter along the side walls (222). Accordingly, the bore (226) changes from a generally circular profile to a generally rectangular profile from the upper portion (227) to the lower portion (229), but any other suitable shapes can be used. In some versions, the upper portion (227) may have a circular diameter of about 78 mm and the lower portion (229) may have a length of about 78 mm and a width of about 46 mm, but any other suitable dimensions can be used. The lower portion (229) may further have a length of about 382 mm, but any other suitable length can be used.

Figure 24:
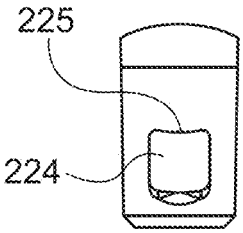
FIG. 24 depicts a partial side elevational view of the nozzle of FIG. 19 taken along circle 24 of FIG. 23.

The side walls (222) comprise the opposing ports (224), as shown in FIG. 24. Each port (224) comprises a substantially rectangular opening in the illustrated embodiment, but any other suitable shape can be used. Each port (224) may have a width of about 55 mm and a length of about 78 mm, but any other suitable dimensions can be used. As best seen in FIG. 20, at least one fillet (225) is positioned above each port (224) of the side walls (222) to form a rounded surface between the side walls (222) and the ports (224). The walls of the ports (224) may then be angled downward through the thickness of the deflector (220). This may be an angle (a) of about 15 degrees relative to the closed end (228), but any other suitable angle can be used. In the illustrated embodiment, the bottom of the ports (224) are positioned about 13 mm from the closed end (228), but any other suitable positioned can be used. Still other suitable configurations for the deflector (220) will be apparent to one with ordinary skill in the art in view of the teachings herein.

Accordingly, the deflector (220) may be positioned at a bottom portion of a continuous casting nozzle (20) and positioned within a mold (18) below the bath level of the liquid steel (2). Liquid steel (2) may thereby flow through the deflector (220), out of the ports (224), and into the mold (18). The deflector (220) may redirect at least a portion of the steel jet (3) toward a center of the deflector (220) along the longitudinal axis (A) before the steel jet (3) exits the deflector (220) through the ports (224). For instance, the sloped wall (223) within the deflector (220) may provide a disruption in the flow of the steel jet (3) to detach at least a portion of the steel jet (3) from the wall (221) of the bore (226) to centrally redirect the steel jet (3). The substantially straight profile of the side walls (222) parallel to the ports (124) may prevent an abrupt separation of the liquid steel (2) from these side walls (222) of the bore (226). As the steel jet (3) reaches the closed end (228) of the bore (226), a swirl may be produced in the steel jet (3) that divides into two flow paths (4) in opposite directions when liquid steel (2) is discharged into the mold (18) from the two ports (224).

The fillets (225) positioned above the ports (224) may provide a smooth transition of the liquid steel (2) from the vertical steel jet (3) flowing from the bore (226) to flow paths (4) of the liquid steel (2) exiting the ports (224). Such a smooth transition may reduce nozzle clogging. Further, the smaller diameter between the walls (121) in the deflector (220) relative to the diameter between the side walls (222) may increase the momentum in the direction of the centerline of the well bottom to direct the steel jet (3). Accordingly, the sloped wall (223) and/or smaller diameter between the walls (221) may detach and redirect the steel jet (3) centrally along the walls (221) transverse to the ports (224), while the substantially straight side walls (122), without a sloped wall (223) and/or a wider diameter may detach and centrally redirect the steel jet (3) a smaller amount above the ports (224). This may allow the fillets (225) to transition the steel jet (3) out of the ports (224) such that the flow paths (4) of the liquid steel (2) are directed along the plane (C) defined by the ports (226) to impinge the narrow faces (17) of the mold (18) instead of the broad faces (19). This redirection of the discharged liquid steel (2) may thereby prevent high asymmetrical flows throughout the volume of the mold (18) such that the flow paths (4) of the liquid steel (2) exiting the deflector (220) are more symmetrical and/or increase the momentum of the upper loops of the flow paths (4) to provide a more desirable flow of the liquid steel (2) into the mold (18). Other suitable configurations for the deflector (220) will be apparent to one with ordinary skill in the art in view of the teachings herein.

In one embodiment, continuous casting nozzle may comprise a deflector at a bottom portion of the nozzle. The deflector may comprise a bore extending through the deflector from an open end to a closed end along a longitudinal axis of the deflector. The bore may comprise a first pair of walls and a second pair of walls transverse to the first pair of walls. A pair of ports may extend through the deflector from the bore to an outer surface of the deflector. A width of the bore between the first pair of walls may be substantially rapidly decreased between an upper portion of the bore and a lower portion of the bore. Each port of the pair of ports may be positioned on opposing walls of the second pair of walls. The pair of ports may be positioned proximally above the closed end of the bore. Each wall of the second pair of walls may comprise at least one fillet positioned above each port to form a rounded surface between each wall and each port. Each port of the pair of ports may extend along a plane substantially parallel with the first pair of walls, wherein each port of the pair of ports may be angled downward relative to the longitudinal axis of the deflector along the plane. Each wall of the first pair of walls may comprise a shelf between the upper portion and the lower portion tranvserse to the longitudinal axis such that each wall of the first pair of walls steps inward toward the longitudinal axis of the deflector. Each wall of the first pair of walls may taper inward toward the longitudinal axis from the shelf to the closed end of the bore. Each wall of the second pair of walls may comprise a shelf tranvserse to the longitudinal axis such that each wall of the second pair of walls steps inward toward the longitudinal axis of the deflector, wherein a thickness of the shelf between the second pair of walls may be smaller than a thickness of the shelf between the first pair of walls. Each wall of the first pair of walls may comprise an arcuate surface at the upper portion and a flat surface at the lower portion. Each wall of the first pair of walls may comprise a slope between the upper portion and the lower portion such that each wall of the first pair of walls slopes inward toward the longitudinal axis of the deflector. Each wall of the first pair of walls may be substantially parallel with the longitudinal axis of the deflector from the slope to the closed end of the bore. Each wall of the second pair of walls may comprise a uniform arcuate surface.

In another embodiment, a continuous casting nozzle may comprise a deflector at a bottom portion of the nozzle. The deflector may comprises a bore extending through the deflector from an open end to a closed end along a longitudinal axis of the deflector. A pair of ports may extend through the deflector from the bore to an outer surface of the deflector. A diameter of the bore may substantially rapidly decrease along the longitudinal axis above the pair of ports such that a portion of a flow of fluid through the deflector becomes detached from a surface of the bore to thereby redirect the flow of fluid toward the longitudinal axis prior to exiting through the pair of ports.

A method for directing a liquid into a continuous casting mold through a nozzle, wherein the nozzle comprises a bore extending through the nozzle from an open end to a closed end along a longitudinal axis and a pair of ports extending through the nozzle from the bore to an outer surface of the nozzle above the closed end, may comprise: positioning a bottom portion of the nozzle within the mold; flowing liquid into the open end of the bore such that a flow path of the liquid is offset from the longitudinal axis of the bore; redirecting the flow path of the liquid through the bore toward the longitudinal axis of the bore such that at least a portion of the flow path of the liquid is detached from a surface of the bore; and dispensing the liquid into the mold through the pair of ports. The nozzle may comprise at least one fillet having a rounded surface positioned above each port of the pair of ports to smoothly transition the flow path of the liquid from vertically along the longitudinal axis to outwardly through the pair of ports tranverse to the longitudinal axis. The pair of ports may be aligned along a plane such that a central portion of each port of the pair of ports extends along the plane, wherein the liquid is directed outwardly from the nozzle along the plane when the liquid is dispensed into the mold through the pair of ports. The liquid may be directed to a narrow face of the mold. The flow path of the liquid dispensed through a first port of the pair of ports may be substantially symmetrical with the flow path of the liquid dispensed through a second port of the pair of ports. A mainstream of the flow path of the liquid dispensed from each port of the pair of ports may be directed outwardly downward from the nozzle and a secondary stream of the flow path of the liquid dispensed from each port of the pair of ports may be directed outwardly upward from the nozzle to form an upper loop. A diameter of the bore may be substantially rapidly decreased to detach at least a portion of the flow path of the liquid from a surface of the bore. The amount of liquid directed toward the longitudinal axis may be increased along the surfaces of the bore that are transverse to the surfaces of the bore comprising the pair of ports.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

What is claimed is:

1. A continuous casting nozzle comprising a deflector at a bottom portion of the nozzle, wherein the deflector comprises:

a bore extending through the deflector from an open end to a closed end along a longitudinal axis of the deflector, wherein the bore comprises a first pair of walls and a second pair of walls, wherein each wall of the first pair of walls is transverse to each wall in the second pair of walls;

a pair of ports extending through the deflector from the bore to an outer surface of the deflector;

wherein a width of the bore between the first pair of walls is substantially rapidly decreased between an upper portion of the bore and a lower portion of the bore;

wherein each port of the pair of ports is positioned on opposing walls of the second pair of walls;

wherein each wall of the first pair of walls comprises a shelf between the upper portion and the lower portion tranvserse to the longitudinal axis such that each wall of the first pair of walls steps inward toward the longitudinal axis of the deflector; and wherein each wall of the second pair of walls comprises a shelf tranvserse to the longitudinal axis such that each wall of the second pair of walls steps inward toward the longitudinal axis of the deflector, wherein a thickness of the shelf between the second pair of walls is smaller than a thickness of the shelf between the first pair of walls.

2. The nozzle of claim 1, wherein the pair of ports are positioned proximally above the closed end of the bore.

3. The deflector of claim 1, wherein each wall of the second pair of walls comprises at least one fillet positioned above each port to form a rounded surface between each wall and each port.

4. The deflector of claim 1, wherein each port of the pair of ports extends along a plane substantially parallel with the first pair of walls, wherein each port of the pair of ports is angled downward relative to the longitudinal axis of the deflector along the plane.

5. The nozzle of claim 1, wherein each wall of the first pair of walls tapers inward toward the longitudinal axis from the shelf to the closed end of the bore.

6. The nozzle of claim 1, wherein each wall of the first pair of walls comprises an arcuate surface at the upper portion and a flat surface at the lower portion.

7. The nozzle of claim 1, wherein each wall of the first pair of walls comprises a slope between the upper portion and the lower portion such that each wall of the first pair of walls slopes inward toward the longitudinal axis of the deflector.

8. The nozzle of claim 7, wherein each wall of the first pair of walls is substantially parallel with the longitudinal axis of the deflector from the slope to the closed end of the bore.

9. The nozzle of claim 1, wherein each wall of the second pair of walls comprises a uniform arcuate surface.

10. A continuous casting nozzle comprising a deflector at a bottom portion of the nozzle, wherein the deflector comprises:

a bore extending through the deflector from an open end to a closed end along a longitudinal axis of the deflector;

a pair of ports extending through the deflector from the bore to an outer surface of the deflector; and wherein a diameter of the bore substantially rapidly decreases along the longitudinal axis at an intermediate portion of the bore between an upper portion of the bore and a lower portion of the bore above the pair of ports such that a portion of a flow of fluid through the deflector becomes detached from a surface of the bore to thereby redirect the flow of fluid toward the longitudinal axis prior to exiting through the pair of ports, wherein the intermediate portion of the bore comprises a slope such that a pair of walls of the bore slopes inward toward the longitudinal axis to direct a mainstream of the fluid dispensed from each port of the pair of ports outwardly downward from the nozzle and a secondary stream of the fluid dispensed from each port of the pair of ports outwardly upward from the nozzle to form an upper loop.

11. A method for directing a liquid into a continuous casting mold through a nozzle, wherein the nozzle comprises a bore extending through the nozzle from an open end to a closed end along a longitudinal axis and a pair of ports extending through the nozzle from the bore to an outer surface of the nozzle above the closed end, wherein the method comprises the steps of:

positioning a bottom portion of the nozzle within the mold;

flowing liquid into the open end of the bore such that a flow path of the liquid is offset from the longitudinal axis of the bore;

redirecting the flow path of the liquid through the bore toward the longitudinal axis of the bore such that at least a portion of the flow path of the liquid is detached from a surface of the bore; and dispensing the liquid into the mold through the pair of ports;

wherein a mainstream of the flow path of the liquid dispensed from each port of the pair of ports is directed outwardly downward from the nozzle and a secondary stream of the flow path of the liquid dispensed from each port of the pair of ports is directed outwardly upward from the nozzle to form an upper loop.

12. The method of claim 11, wherein the nozzle comprises at least one fillet having a rounded surface positioned above each port of the pair of ports to smoothly transition the flow path of the liquid from vertically along the longitudinal axis to outwardly through the pair of ports tranverse to the longitudinal axis.

13. The method of claim 11, wherein the pair of ports are aligned along a plane such that a central portion of each port of the pair of ports extends along the plane, wherein the liquid is directed outwardly from the nozzle along the plane when the liquid is dispensed into the mold through the pair of ports.

14. The method of claim 13, wherein the liquid is directed to a narrow face of the mold.

15. The method of claim 11, wherein the flow path of the liquid dispensed through a first port of the pair of ports is substantially symmetrical with the flow path of the liquid dispensed through a second port of the pair of ports.

16. The method of claim 11, wherein a diameter of the bore is substantially rapidly decreased to detach at least a portion of the flow path of the liquid from a surface of the bore.

17. The method of claim 11, wherein the amount of liquid directed toward the longitudinal axis is increased along the surfaces of the bore that are transverse to the surfaces of the bore comprising the pair of ports.

18. The nozzle of claim 6, wherein a the flat surface of the first pair of walls of the bore is parallel with the flat surface of the outer diameter of the defector.

* * * * *